US005916859A

United States Patent [19]

Choy et al.

[11] Patent Number: 5,916,859

[45] Date of Patent: *Jun. 29, 1999

[54] HEXADECYL AMINE OXIDE/COUNTERION COMPOSITION AND METHOD FOR DEVELOPING EXTENSIONAL VISCOSITY IN CLEANING COMPOSITIONS

[75] Inventors: Clement K. Choy, Alamo; Paul F. Reboa, Dublin, both of Calif.

[73] Assignee: The Clorox Company, Oakland, Calif.

[ * ] Notice: This patent is subject to a terminal disclaimer.

[21] Appl. No.: 08/475,281

[22] Filed: Jun. 7, 1995

Related U.S. Application Data

[63] Continuation of application No. 08/324,316, Oct. 17, 1994, Pat. No. 5,462,689, which is a continuation of application No. 07/963,144, Oct. 19, 1992, abandoned.

[51] Int. Cl.[6] ..... C11D 1/75; C11D 3/395; C11D 17/00

[52] U.S. Cl. ..... 510/195; 510/373; 510/380; 510/433; 510/503

[58] Field of Search ..... 252/89.1, 90, 99, 252/102, 103, 156, 173, 174.14, 187.27, 528, 531, 535, 539, 547, 550, 554, 558, DIG. 14; 134/34; 510/195, 373, 380, 427, 433, 340, 341, 503

[56] References Cited

U.S. PATENT DOCUMENTS

| | | | |
|---|---|---|---|
| 3,296,145 | 1/1967 | Findlan | 252/106 |
| 3,560,389 | 2/1971 | Hunting | 252/95 |
| 3,684,722 | 8/1972 | Hynam et al. | 252/98 |
| 4,229,313 | 10/1980 | Joy | 252/98 |
| 4,282,109 | 8/1981 | Citrone et al. | 252/102 |
| 4,337,163 | 6/1982 | Schilp | 252/96 |
| 4,388,204 | 6/1983 | Dimond et al. | 252/98 |
| 4,399,050 | 8/1983 | Bentham et al. | 252/95 |
| 4,576,728 | 3/1986 | Stoddart | 252/102 |

(List continued on next page.)

FOREIGN PATENT DOCUMENTS

| | | |
|---|---|---|
| 110 544 | 6/1984 | European Pat. Off. . |
| 129 980 | 1/1985 | European Pat. Off. . |
| 144 166 | 6/1985 | European Pat. Off. . |
| 145 084 | 6/1985 | European Pat. Off. . |
| 274 885 | 7/1988 | European Pat. Off. . |
| 373 864 | 6/1990 | European Pat. Off. . |
| 62-158799 | 7/1987 | Japan . |
| 62-286000 | 12/1987 | Japan . |
| 63-72798 | 4/1988 | Japan . |

OTHER PUBLICATIONS

Kirk–Othmer, *Encyclopedia of Chemical Technology*, 3d Ed., vol. 20, 271–272 and 317–318.

T. P. Matson, "Recent Advances in Fatty Amine Oxides Part II. Formulation and Use," *J.Am. 0–1 Chemists' Society*, vol. 40, pp. 640–642.

*Primary Examiner*—Ardith Hertzog

*Attorney, Agent, or Firm*—Sharon R. Kantor

[57] ABSTRACT

The present invention is a thickened viscoelastic cleaning composition comprising, in aqueous solution:

(a) 0.1 to 15.0 weight percent of an active cleaning compound; and (b) 0.2 to 7.5 weight percent of a viscoelastic thickening system comprising about 0.1 to 5.0 weight percent of a hexadecyl di ($C_{1-2}$ alkyl) amine oxide having an alkyl chain length of at least 80% $C_{16}$, and about 0.1 to 2.5 weight percent of an organic counterion selected from aryl or $C_{2-6}$ alkyl carboxylates, sulfated $C_{2-6}$ alkyl or aryl alcohols and mixtures thereof; where the aryl group is derived from benzene or naphthalene and is substituted or substituted with $C_{1-4}$ alkyl groups, $C_{1-4}$ alkoxy groups, halogens, nitro groups or mixtures thereof;

wherein the ratio of amine oxide to counterion is between 4:1 and 1:2, the system possesses a Trouton ratio of at least about 50 at a shear rate of 500–10,000 $sec^{-1}$, an initial viscosity measured at 21° C. and 5 rpm is at least 20 cP, and the composition pH is above about 10.5.

The composition of the present invention may be formulated to have utility as a hard surface cleaner, or as a drain-opener.

6 Claims, 3 Drawing Sheets

U.S. PATENT DOCUMENTS

| | | | |
|---|---|---|---|
| 4,585,570 | 4/1986 | Nelson | 252/102 |
| 4,783,283 | 11/1988 | Stoddart | 252/545 |
| 4,789,495 | 12/1988 | Cahall et al. | 252/95 |
| 4,800,036 | 1/1989 | Rose | 252/102 |
| 4,839,079 | 6/1989 | Wainberg et al. | 252/104 |
| 4,842,771 | 6/1989 | Rörig | 252/547 |
| 4,853,146 | 8/1989 | Rörig | 252/142 |
| 4,900,467 | 2/1990 | Smith | 252/95 |
| 5,011,538 | 4/1991 | Smith | 134/22.13 |
| 5,041,239 | 8/1991 | Rörig | 252/315.1 |
| 5,055,219 | 10/1991 | Smith | 252/102 |
| 5,078,896 | 1/1992 | Rörig | 252/102 |
| 5,462,689 | 10/1995 | Choy | 510/373 |

HEXADECYL AMINE OXIDE/COUNTERION COMPOSITION AND METHOD FOR DEVELOPING EXTENSIONAL VISCOSITY IN CLEANING COMPOSITIONS

This is a continuation of application Ser. No. 08/324,316 filed Oct. 17, 1994, now U.S. Pat. No. 5,462,689, which is a continuation of application Ser. No. 07/963,144 filed Oct. 19, 1992, now abandoned.

BACKGROUND OF THE INVENTION

1. Field of The Invention

The present invention relates to cleaning compositions having a viscoelastic rheology and, in particular, to hypochlorite compositions having a viscoelastic rheology which are formulated to have enhanced extensional viscosity.

2. Description of Related Art

Much art has addressed the problem of developing a thickened cleaning composition, which may contain a bleach and may have utility as a hard surface cleanser or a drain opener. The efficacy of such compositions is greatly improved by viscous formulations, increasing the residence time of the cleaner. Splashing during application and use is minimized, and consumer preference for a thick product is well documented. Schilp, U.S. Pat. No. 4,337,163, shows a hypochlorite thickened with an amine oxide or a quaternary ammonium compound, and a saturated fatty acid soap. Stoddart, U.S. Pat. No. 4,576,728, shows a shear-thinning thickened hypochlorite including 3- or 4-chlorobenzoic acid, 4-bromobenzoic acid, 4-toluic acid and 3-nitrobenzoic acid in combination with an amine oxide. Bentham et al., U.S. Pat. No. 4,399,050, discloses hypochlorite thickened with certain carboxylated surfactants, amine oxides and quaternary ammonium compounds. Citrone et al., U.S. Pat. No. 4,282,109, claims hypochlorite bleach thickened with a $C_{10-18}$ amine oxide plus a $C_{8-12}$ alkyl sulfate, and a ratio of amine oxide:sulfonate of at least 3:4.

Rorig et al, U.S. Pat. No. 4,842,771, discloses a tertiary amine oxide which may be $C_{16}$ combined with cumene, xylene or toluene sulfonate, but also requires 1–5% of an acid, and the composition pH must not exceed about 6, thereby excluding alkaline cleaners. Rose, U.S. Pat. No. 4,800,036, describes viscoelastic hypochlorite solutions thickened with "onium surfactant ions" and aromatic sulfonate or carboxylate counterions. Stoddart, U.S. Pat. No. 4,783,283, describes a shear thinning hypochlorite containing composition containing 0.1% to 5% of a $C_{12-15}$ amine oxide combined with 0.05% to 0.5% of an alkylated benzene or napthalene sulfonate. The disclosure of Stoddart is limited to the $C_{15}$ chain length and the two specified aryl sulfonates.

Hunting, U.S. Pat. No. 3,560,389, discloses an unthickened hypochlorite bleaching composition utilizing an amine oxide and an alkylated benzene or naphthalene sulfonate. Hynam et al, U.S. Pat. No. 3,684,722, teaches thickening hypochlorite with an amine oxide and a soap. Neither of these references, teach or suggest a viscoelastic thickening system.

SUMMARY OF THE PRESENT INVENTION

It has been found that many thickeners of the prior art are unsatisfactory in a cleaning composition as contemplated herein, particularly when employed to thicken hypochlorite compositions. Inorganic thickeners, for example, are generally undesirable particularly in spray-type dispensers since the thickeners would interfere with dispensing.

The present invention is further characterized as a means of reducing the characteristic "bleach odor" found in hypochlorite cleaning compositions of the art, particularly those which are volatilized upon dispensing. The bleach odor may result from the chlorine releasing compound itself, from molecular chlorine, or from related compounds. Even when fragrances are added, the bleach odor often persists, to the dissatisfaction of the consumer/user.

By contrast, in the prior art, some odor reduction was found possible in foam-type dispensers. However, these dispensers were characterized by they need for applying the foam material directly from the dispenser onto the surface to be cleaned. Accordingly, these dispensers were relatively inefficient in their inability to rapidly apply the foam material to large areas of the surface to be cleaned.

As noted above, the use of the composition of the present invention in such spray-type dispensers requires shear sensitivity or shear thinning of the composition as it passes through the pumping mechanism of the dispenser. In addition, it is important that the composition immediately recover its thickened character in order to properly adhere to the surface to be cleaned. This characteristic is generally referred to as rapid viscosity recovery. Additionally reduction in bleach odor requires a composition which, when dispensed through a nozzle or orifice, exhibits an increase in extensional viscosity. This reduced odor is thought to be due principally to reduced misting since the extensional viscosity property tends to develop larger droplets at the dispensing nozzle or orifice.

The surfactant combination of the present invention affords viscosities ranging, for example, from 20 up to 5,000 centipoise and even greater for simultaneously achieving desired thickening as well as stabilization of the composition and a reduction of bleach odor. These essential characteristics are realized where the composition is employed in a wide variety of dispensers for directing the composition as a spray, stream or otherwise onto hard surfaces to be cleaned. More specifically, as also noted above, the invention particularly contemplates the use of the composition in spray-type dispensers such as manually operated trigger-type dispensers sold for example by Specialty Packaging Products, Inc. or Continental Sprayers, Inc. These types of dispensers are also disclosed, for example, in U.S. Pat. No. 4,701,311 to Dunning et al and U.S. Pat. No. 4,646,973 and 4,538,745 both to Focaracci. In these dispensers, the composition is divided into relatively fine particles which are then directed as a spray onto the surface to be cleaned. The spray dispenser is particularly desirable in its ability to uniformly apply the composition to a relatively large area of the surface.

It is therefore an object of the present invention to provide a viscoelastic, thickened hypochlorite composition, having a viscoelastic rheology and which is adapted to dispensing via a trigger sprayer.

It is another object of the present invention to provide a hypochlorite composition having reduced misting and bleach odor.

It is yet another object of the present invention to provide a thickened hypochlorite composition which is phase-stable during normal storage, and at elevated or low temperatures.

It is another object of the present invention to provide a stable thickened hypochlorite composition with a viscoelastic rheology for increased drain opening efficacy.

It is another object of the present invention to provide a bleach stable viscoelastic thickening system which is effective at both high and low ionic strength.

Briefly, a first embodiment of the present invention comprises a stable cleaning composition having a viscoelastic rheology comprising, in aqueous solution:

(a) an active cleaning compound; and (b) a viscoelastic thickening system comprising a hexadecyl dialkyl amine oxide and an organic counterion.

A number of additional components may be added to the foregoing composition of the first embodiment. The additional components function as hereinafter described and serve to improve or enhance stability, rheology, efficacy and/or aesthetics or consumer acceptance of a commercial product.

Viscoelasticity is imparted to the composition by a system including a hexadecyl dialkyl amine oxide and an organic counterion. The viscosity of the formulations of the present invention can range from slightly greater than that of water, to several thousand centipoise (cP). Preferred from a consumer standpoint is a viscosity range of about 20 cP to 1000 cP, more preferred is about 50 cP to 500 cP, and most preferred, for dispensing via a trigger-type dispenser, is about 100 cP to 300 cP.

It is an advantage of the present invention that the hypochlorite composition is thickened, with a viscoelastic rheology.

It is another advantage of the present invention that the viscoelastic thickener is chemically and phase-stable in the presence of a variety of cleaning actives, including hypochlorite, and retains such stability at both high and low temperatures.

It is a further advantage of the present invention that the viscoelastic thickener is effective at both high and low ionic strength.

It is a further advantage of the present invention that the rheology of the composition results in shear thinning behavior for ease of dispensing, and extensional viscosity for odor reduction.

It is yet another advantage of the composition of the present invention that thickening is achieved with relatively low levels of surfactant, improving chemical and physical stability.

These and other objects and advantages of the present invention will no doubt become apparent to those skilled in the art after reading the following Detailed Description of the Preferred Embodiments.

DETAILED DESCRIPTION OF THE PREFERRED EMBODIMENTS

In the Drawings

Figure 1:
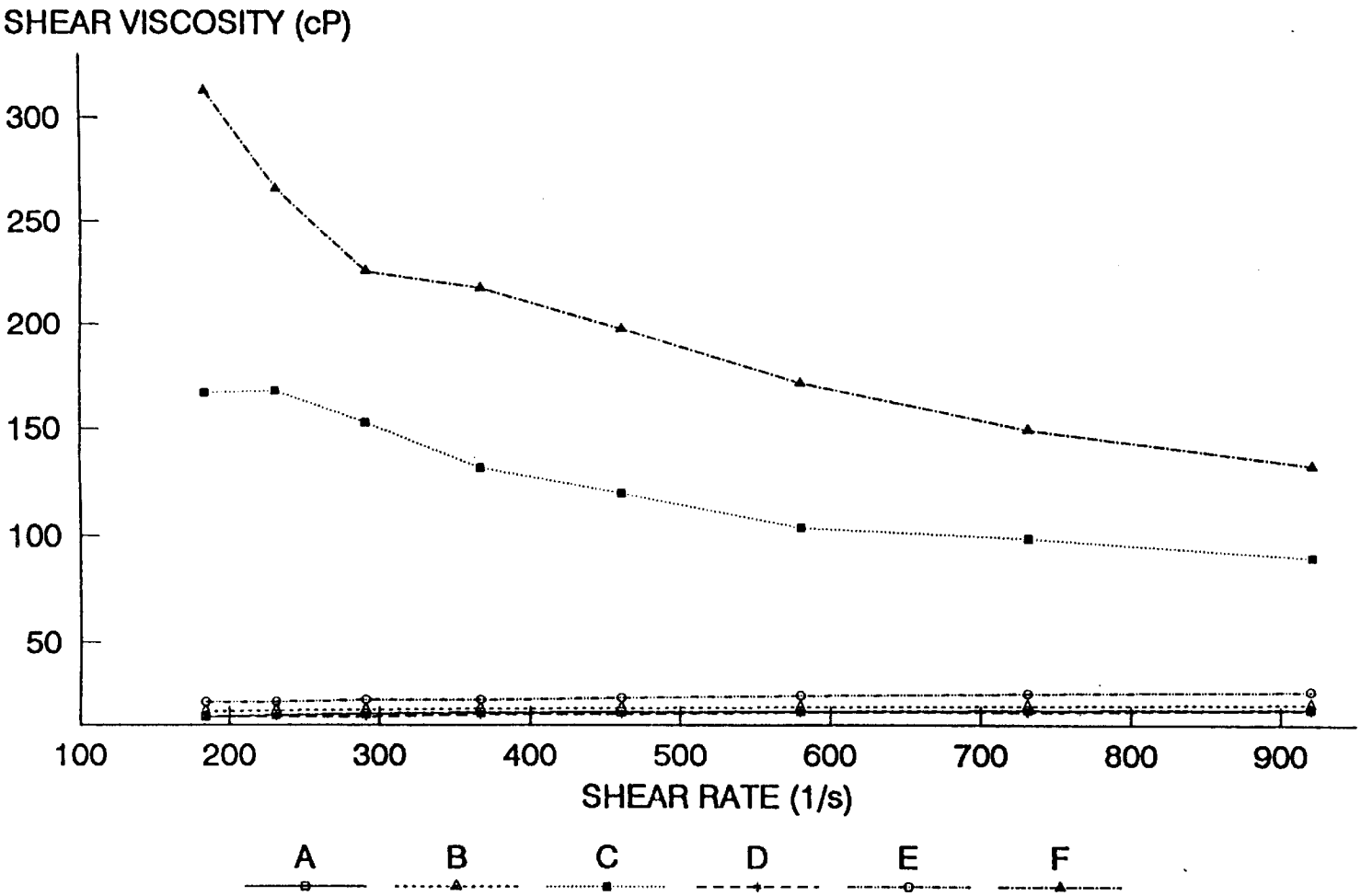
FIG. 1 is a graph of shear viscosity vs. shear rate showing two formulations of the present invention and four prior art formulations.

In a first embodiment, the present invention is a thickened viscoelastic cleaning composition comprising, in aqueous solution:

(a) an active cleaning compound; and (b) a viscoelastic thickening system comprising a hexadecyl dialkyl amine oxide and an organic counterion.

A number of additional components may be added to the foregoing composition of the first embodiment. The additional components function as hereinafter described and serve to improve or enhance stability, rheology, efficacy and/or aesthetics or consumer acceptance of a commercial product.

Active Cleaning Compounds

A number of cleaning compounds are known and are compatible with the viscoelastic thickener. Such cleaning compounds interact with their intended target materials either by chemical or enzymatic reaction or by physical interactions, which are hereinafter collectively referred to as reactions. Useful reactive compounds include acids, bases, oxidants, reductants, solvents, enzymes, thioorganic compounds, surfactants (detergents) and mixtures thereof. Examples of enzymes include proteases, amylases, and cellulases. Useful solvents include saturated hydrocarbons, ketones, carboxylic acid esters, terpenes, glycol ethers, and the like. Oxidants, e.g. bleaches, are a preferred cleaning active, and may be selected from various halogen or peroxygen bleaches. Particularly preferred is a halogen bleach source which may be selected from various hypochlorite-producing species, for example, bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromocyanuric acid, dibromo and dichlorocyanuric acid, and potassium and sodium salts thereof, N-brominated and N-chlorinated succinimide, malonimide, phthalimide and naphthalimide. Also suitable are hydantoins, such as dibromo and dichlorodimethylhydantoin, chlorobromodimethylhydantoin, N-chlorosulfamide (haloamide) and chloramine (haloamine).

Particularly preferred in this invention is sodium hypochlorite having the chemical formula NaOCl, in an amount ranging from about 0.1 weight percent to about 15 weight percent, more preferably about 0.2% to 10%, and most preferably about 2.0% to 6.0%.

Amine Oxide

As mentioned hereinabove, the surfactant suitable for use in this invention is a bleach-stable nonionic surfactant. It is especially preferred to use amine oxides, especially trialkyl amine oxides. A representative structure is set forth below.

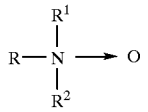

In the structure above, R is 16 carbon alkyl, and $R^1$ and $R^2$ are each 1 to 2 carbons, and are most preferably methyl. When $R^1$ and $R^2$ are both methyl and R is alkyl averaging 16 carbon atoms, the structure for dimethylhexadecylamine oxide, a particularly preferred amine oxide, is obtained. Representative examples of this particular bleach-stable nonionic surfactant include those sold under the trademark AMMONYX® CO by Stepan Chemical Company, and BARLOX 16S by Lonza Corporation. The R group is preferably straight-chained, although some degree of branching is acceptable at about the gamma carbon or further. Generally, the more distal the carbon relative to the amine group, the longer the branched chain may be. Amine oxides having a branched R group are thus considered to be within the scope of the present invention as long as the longest chain of the branched R group contains no more than 16 carbons. The amine oxide is present in a thickening effective amount, preferably about 0.1 - 5.0, more preferably about 0.3–3.0, most preferably 0.5–1.5, all percentage by weight of the composition.

Figure 2:
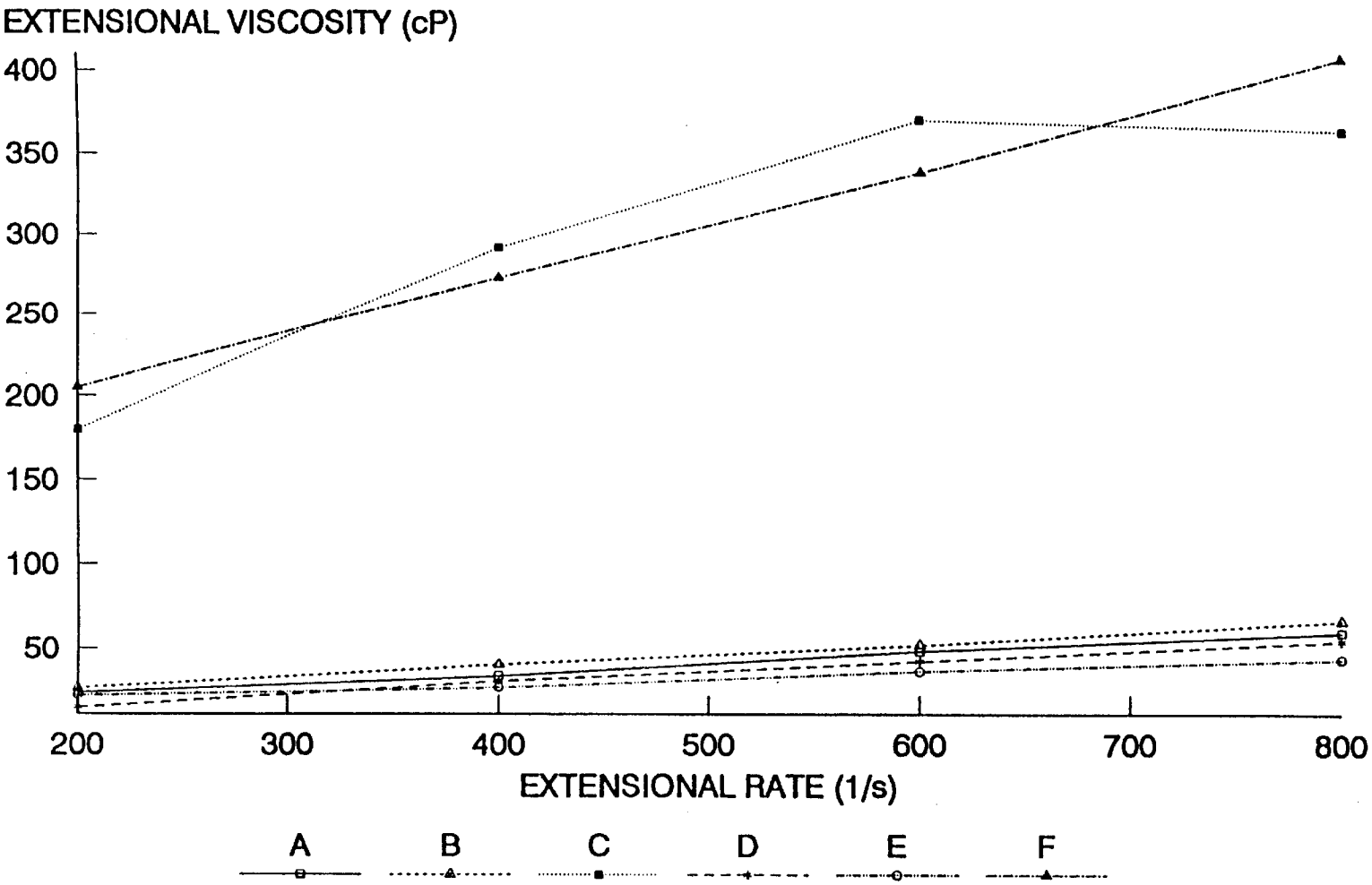
FIG. 2 is a graph showing extensional viscosity vs. extensional rate for two formulations of the present invention and four prior art formulations.

The chain length of the amine oxide is important to this development. The use of a $C_{12}$ or a $C_{14}$ amine oxide does not result in large extensional properties and, subsequently, does not reduce odor. The $C_{18}$ amine oxide is not suitable due to its poor solubility and very high shear viscosity, making it difficult to pump in a spray application. It is important that the amine oxide contain a relatively high percentage of the $C_{16}$ alkyl group. Preferred is about 80% $C_{16}$, more preferred is 95%, and most preferred is 99%. Purity of chain length is important as mixed chain lengths can result in mixed micelles, mitigating or destroying the extensional viscosity. In general, the degree of extensional viscosity buildup is obtained by comparing the extensional viscosity with the shear viscosity (ie. "normal" viscosity as measured with a Brookfield or Bohlin viscometer). Extensional viscosities herein are measured with a Rheometrics RFX extensional rheometer. Water, for instance, will have a ratio of extensional to shear viscosity (a Trouton ratio) of 3, regardless of the rates of shearing or extending. In order to obtain reduced misting and odor, the ratio required appears to be at least 50, more favorably 70, and best at over 100 at the shear rates of the spray application (approximately 500–10,000 $s^{-1}$). The ratio will vary depending on the extensional and shear rates. Systems which exhibit extensional properties are non-Newtonian systems, in which the viscosity is a function of the shear. FIGS. 1 and 2 illustrate the differences between Newtonian systems of the art, and the extensional system of the present invention. FIG. 1 is a graph of shear rate vs. viscosity for two compositions of the present invention and four prior art compositions. The viscosities of FIG. 1 are shear viscosities, measured with a Bohlin VOR Rheometer. FIG. 2 illustrates the same compositions wherein extensional viscosities were measured on the Rheometrics RFX Rheometer. All samples comprised amine oxide, sodium xylene sulfonate, 2.0% sodium hypochlorite, 0.55% sodium hydroxide, and water. Samples "C" and "F", representing the present invention, employed the $C_{16}$ amine oxide. The remaining samples, representing the prior art, comprised $C_{12}$ amine oxide (samples "A" and "D") and $C_{14}$ amine oxide (samples "B" and "E"). Additionally, samples "A", "B" and "C" contained 0.5% amine oxide and 0.25% counterion, while "D", "E" and "F" employed 1.0% amine oxide and 0.5% counterion, all by weight of the composition.

Organic Counterion

The organic counterion is selected from the group consisting of aryl and $C_{2-6}$ carboxylates, aryl and $C_{2-6}$ sulfonates, sulfated aryl alcohols, and mixtures thereof. The aryl compounds are derived from benzene or napthalene and may be substituted or not.

The counterion may include substituents which are chemically stable with the active cleaning compound. Preferably, the substituents are alkyl or alkoxy groups of 1–4 carbons, halogens and nitro groups, all of which are stable with most actives, including hypochlorite. The counterions may be added in acid form and converted to the anionic form in situ, or may be added in anionic form. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. The counterion is added in an amount sufficient to thicken and result in a viscoelastic rheology, and preferably between about 0.1 to 2.5, more preferably between about 0.2 to 1, and most preferably about 0.2 to 0.5 weight percent of the composition. A preferred weight ratio of amine oxide to counterion is between about 4:1 and 1:2, a more preferred ratio is about 3:1 to 1:2, and most preferred is about 2:1. The ratio dependence indicates that the structure of the mixed micelle is the determining factor in obtaining extensional properties. Without limiting to a particular theory, it is thought that the counterion promotes the formation of elongated rod-like micelles with the amine oxide. These micelles can form a network which results in efficient thickening. It has been surprisingly found that the viscoelastic thickening as defined herein occurs only when the counterion is minimally or non surface-active.

Co-surfactants

Thickening can be enhanced, and low temperature phase stability improved, through the addition of a cosurfactant selected from the group consisting of quaternary ammonium compounds, betaines, sarcosinates, taurides, and mixtures thereof. Additionally, non- thickening cosurfactants can be added for other purposes as desired, e.g. detergency, solubilization, wetting, etc. Amine oxides having R groups other than $C_{16}$ may be added so long as the rod micelle formation is not adversely affected. Generally sufficient rod micelles are present when the composition Trouton ratio is above about 50. The foregoing cosurfactants may be added in an amount effective to accomplish their desired function, and generally in a weight percentage range of 0% to about 5%, more preferably 0.1% to about 2%.

pH Adjusting Agent pH adjusting agents may be added to adjust the pH. Buffers, on the other hand, may act to maintain pH, and in this instance, alkaline pH is favored for purposes of both rheology and maintaining hypochlorite stability. Examples of buffers include the alkali metal phosphates, polyphosphates, pyrophosphates, triphosphates, tetraphosphates, silicates, metasilicates, polysilicates, carbonates, hydroxides, and mixtures of the same. Control of pH may be necessary to maintain the stability of the halogen source and to avoid protonating the amine oxide for the latter purpose, the pH should be maintained above the pKa of the amine oxide. Thus for the hexadecyl dimethyl amine oxide, the pH should be above about 6. Where the active halogen source is sodium hypochlorite, the pH is maintained above about pH 10.5, preferably above or about pH 12. Most preferred for this purpose are the alkali metal hydroxides, especially sodium hydroxide. The total amount of pH adjusting agent/buffer including that inherently present with bleach plus any added, can vary from about 0% to 5%, preferably from about 0.1–1.0%.

Electrolyte

An electrolyte may be added to promote viscosity development. Electrolytes function, on the one hand, to provide sources of ion (generally anions) in aqueous solution. This provides a charged medium in which the surfactants can interact, providing the rheology of the invention. Some compounds will serve as both buffer and electrolyte. These particular buffers/electrolytes are generally the alkali metal salts of various inorganic acids, to wit: the alkali metal salts of phosphates, polyphosphates, pyrophosphates, triphosphates, tetraphosphates, silicates, metasilicates, polysilicates, carbonates, hydroxides, and mixtures of the same. Certain divalent salts, e.g. alkaline earth salts of phosphates, carbonates, hydroxides, etc., can function singly as buffers. If such compounds were used, they would be combined with at least one of the previous electrolytes/buffers mentioned to provide the appropriate pH adjustment. Bleach-stable organic materials, such as gluconates, succinates, maleates, sodium chloride or sodium sulfate could be utilized as electrolytes to maintain the ionic strength for the desired rheology. It may be noted that where sodium hypochlorite is the cleaning active, sodium chloride is typically present as a by-product of the hypochlorite formation, and additional electrolyte is generally unnecessary. An especially preferred electrolyte/buffer is an alkali metal silicate. The preferred silicate is sodium silicate, which has the empirical formula $Na_2O:SiO_2$. The ratio of sodium oxide:silicon dioxide is about 1:4 to 2:1, more preferably about 1:2. Silicates are available from numerous sources, such as PQ Corporation. The amount of deliberately added electrolyte can vary from about 0% to 10.0%, preferably from about 0.1% to 5%.

Adjuncts

The composition of the present invention can be formulated to include such components as fragrances, coloring agents, whiteners, solvents, chelating agents and builders, which enhance performance, stability or aesthetic appeal of the composition. From about 0.01% to about 0.5% of a fragrance such as those commercially available from International Flavors and Fragrance, Inc. may be included in any of the compositions of the first, second or third embodiments. Dyes and pigments may be included in small amounts. Ultramarine Blue (UMB) and copper phthalocyanines are examples of widely used pigments which may be incorporated in the composition of the present invention. Suitable builders which may be optionally included comprise carbonates, phosphates and pyrophosphates, exemplified by such builders function as is known in the art to reduce the concentration of free calcium or magnesium ions in the aqueous solution. Certain of the previously mentioned buffer materials, e.g. carbonates, phosphates, phosphonates, polyacrylates and pyrophosphates also function as builders.

A second embodiment of the present invention is a drain cleaning formulation which includes:

(a) a viscoelastic thickener comprising a hexadecyl dialkyl amine oxide and an organic counterion;

(b) an alkali metal hydroxide;

(c) an alkali metal silicate;

(d) an alkali metal carbonate; and (e) a drain opening active.

Component (a) comprises the viscoelastic thickener as described previously. The alkali metal hydroxide is preferably potassium or sodium hydroxide, and is present in an amount of between about 0.5% and 20%. The preferred alkali metal silicate is one having the formula $M_2O(SiO)_n$ where M is an alkali metal and n is between 0.5 and 4. Preferably M is sodium and n is 2.3. The alkali metal silicate is present in an amount of about 0% to 5%. The preferred alkali metal carbonate is sodium carbonate, at levels of between about 0% and 5%. About 1% to 10% cleaning active, is present, preferably about 4% to 8%. Sodium chloride or similar salts may be added as a densifying agent to result in a composition density greater than that of water, thus aiding in penetration through standing water.

The drain opening active is an acid, base, solvent, oxidant, reductant, enzyme, surfactant or thioorganic compound, or mixtures thereof, suitable for opening drains. Such materials include those as previously described in the first embodiment which act by either chemically reacting with the clog material to fragment it or render it more water-soluble or dispersible, physically interacting with the clog material by, e.g. adsorption, absorption, solvation, or heating (i.e. to melt grease), or by enzymatically catalyzing a reaction to fragment or render the clog more water-soluble or dispersible. Particularly suitable are alkali metal hydroxides and hypochlorites. Combinations of the foregoing are also suitable. The drain opener may also contain various adjuncts as known in the art, including corrosion inhibitors, dyes and fragrances.

Viscoelasticity is defined as a liquid that has both elastic or solid-like properties and viscous (only liquid) behavior. Solutions made from $C_{12}$ or $C_{14}$ amine oxides exhibit very little viscoelastic properties, as demonstrated by a frequency sweep with a BoHin VOR rheometer. However, the use of the $C_{16}$ amine oxide in conjunction with sodium xylene sulfonate, gives rise to a large viscoelastic response, with a relaxation time far in excess of those outlined in the art. Stoddard teaches that the modal relaxation time should not exceed 0.5 seconds at 10° C., and the zero-shear viscosity should be at least 500 cP, and preferably is greater than 1,000 cP. As defined by Stoddard, the modal relaxation time for the $C_{16}$AO/SXS system of the above formula cannot be measured because the loss modulus does not go through a maximum (ie. does not behave as a Maxwell body). This is a clear indication that the Theological behavior is not the same for the $C_{16}$AO/SXS as compared to the $C_{12\ or\ 14}$AO/SXS. However, an estimate of the relaxation time can be made by determining the inverse of the frequency at the crossover point, that is, where G' and G" are equal. By this approximation, the relaxation time for the $C_{16}$AO/SXS system is between 4 to 3 seconds. Further, the zero-shear viscosity reaches a maximum at 400 cP. Another example of the different rheological properties between the $C_{12,14}$ and $C_{16}$AO/SXS systems is the shear viscosity profile as a function of shear. At low shear rates, both the $C_{12}$ and $C_{14}$AO/SXS behave like Newtonian liquids; that is, the viscosity is constant as a function of shear rate. When the shear rate is higher, however, slight shear thickening occurs, with the viscosity increasing as the shear rate increase. In contrast, the $C_{16}$AO/SXS always shows shear thinning behavior; that is, the viscosity decreases with shear rate. This is demonstrated in FIGS. 1 and 2. The shear thinning behavior allows the spraying of the product under high shear conditions.

Formation of rod-like micelles is expected whenever packing geometrical considerations allow it; that is, if the repulsive forces between surfactant head-groups (whether electrostatic from ionic charge or steric) can be reduced, then larger, rod-like micelles can be formed, even at the same concentration as would normally only form normal spherical micelles. Geometrical considerations have been considered from a semi-empirical point of view by Israelachvili (JCS Faraday, 1976) in his v/aL treatment, where v is the total volume of the hydrocarbon tail, a is the head-group area, and L is length of the hydrocarbon chain. To form rod-like micelles, the v/aL ratio must be greater than ⅓ but not larger than ½ (larger ratios will start the formation of lamellar and other structures). It can be seen that an important parameter in this ratio is the hydrocarbon chain length, as the amine oxide head group is constant. Also, the sulfonate counterion permits the head groups to come closer together because of the reduction in the electrostatic repulsion caused by the interaction of the sulfonate anion with the partially positively charged nitrogen of the amine oxide; in essence, this causes a reduction in the factor a, the head group area.

Rod-like micelles result in extensional viscosity based upon extensional flow. The extensional flow, as it occurs in the nozzle of a sprayer, is uniaxial and in essence stretches molecules passing through it. If the molecules are long but naturally coiled, as in rod micelles, the extensional flow will literally straighten the molecules out, causing them to occupy much more volume than in a normal three-dimensional flow field. Because of the constricted movement and the resulting loss of volume to move about, the viscosity (extensional) goes up by factors of 10 to 1,000. The excess viscosity forms larger drops at the nozzle, and remains cohesive, minimizing mist formation. The larger drops will also settle down faster by gravity, again minimizing contact with the bleach solution.

The composition may also have utility as a hard surface cleaner. The thick solutions are clear and transparent, and can have higher viscosities than hypochlorite solutions of the art. Because viscoelastic thickening is more efficient, less surfactant is needed to attain the viscosity, and chemical and physical stability of the composition generally is better. Less surfactant also results in a more cost-effective composition. As a hard surface cleaner, the viscoelastic rheology prevents the composition from spreading on horizontal sources and thus aids in protecting nearby bleach-sensitive surfaces. The viscoelasticity also provides the benefits of a thick system, e.g. increased residence time on non-horizontal surfaces. On non-horizontal surfaces, the composition flows off at a much slower rate, and a film is left which can yield very effective cleaning.

Advantageously, the surfactant thickening system is not diminished by ionic strength, nor does it require ionic strength for thickening. The viscoelastic compositions of the present invention are phase-stable and retain their rheology in solutions with more than about 0.5 weight percent ionizable salt, e.g. sodium chloride and sodium hypochlorite, corresponding to an ionic strength of about 0.09 g-ions/Kg solution. It is expected that the viscoelastic rheology would remain even at ionic strengths of at least about 6 g-ions/Kg. The surfactant system also does not significantly degrade hypochlorite even after prolonged (26 months) storage. Compositions ranging from 0.8 to 1.25 weight percent total surfactant did not result in appreciable loss of hypochlorite.

Experimental

TABLE I

| | Control | H | I | J | K | L | M | N |
|---|---|---|---|---|---|---|---|---|
| Wt. % amine oxide[1] | 0.5 | 0.25 | 0.30 | 0.50 | 0.75 | 1.0 | 0.75 | 0.75 |
| Wt. % Counterion[2] | 0 | 0.12 | 0.19 | 0.24 | 0.38 | 0.5 | 1.5 | 0.12 |
| Bleach odor vs. Control | | +++ | + | +++ | +++ | + | ++ | ++ |

[1]Hexadecyl dimethyl amine oxide
[2]Sodium xylene sulfonate
+ = slight improvement; ++ = improvement; +++ = substantial improvement Table I illustrates the reduction in bleach odor attained by samples "H"–"N", all compositions of the present invention. Two PVC boxes (16"×24"×23.5") consisting of side, bottom and top panels were assembled. Test samples were poured into high density polyethylene bottles which were equipped with bleach-compatible trigger sprayers. The nozzle of each trigger sprayer was adjusted to full open. The sprayers were primed by dispensing the product into a sink with three or four squeezes of the trigger. The control or test product was sprayed within five seconds onto the back wall of the box with five squeezes of the trigger. Evaluators by two's immediately sniffed the box and graded the bleach odor/irritation intensity on a numerical scale. These numerical scores were averaged and compared to the control average. The resulting scores were divided into the three categories reported above. The control samples were unthickened bleach compositions. As can be seen, all samples showed at least a slight improvement, i.e. reduction in bleach odor, and three samples displayed a substantial improvement.

Figure 3:
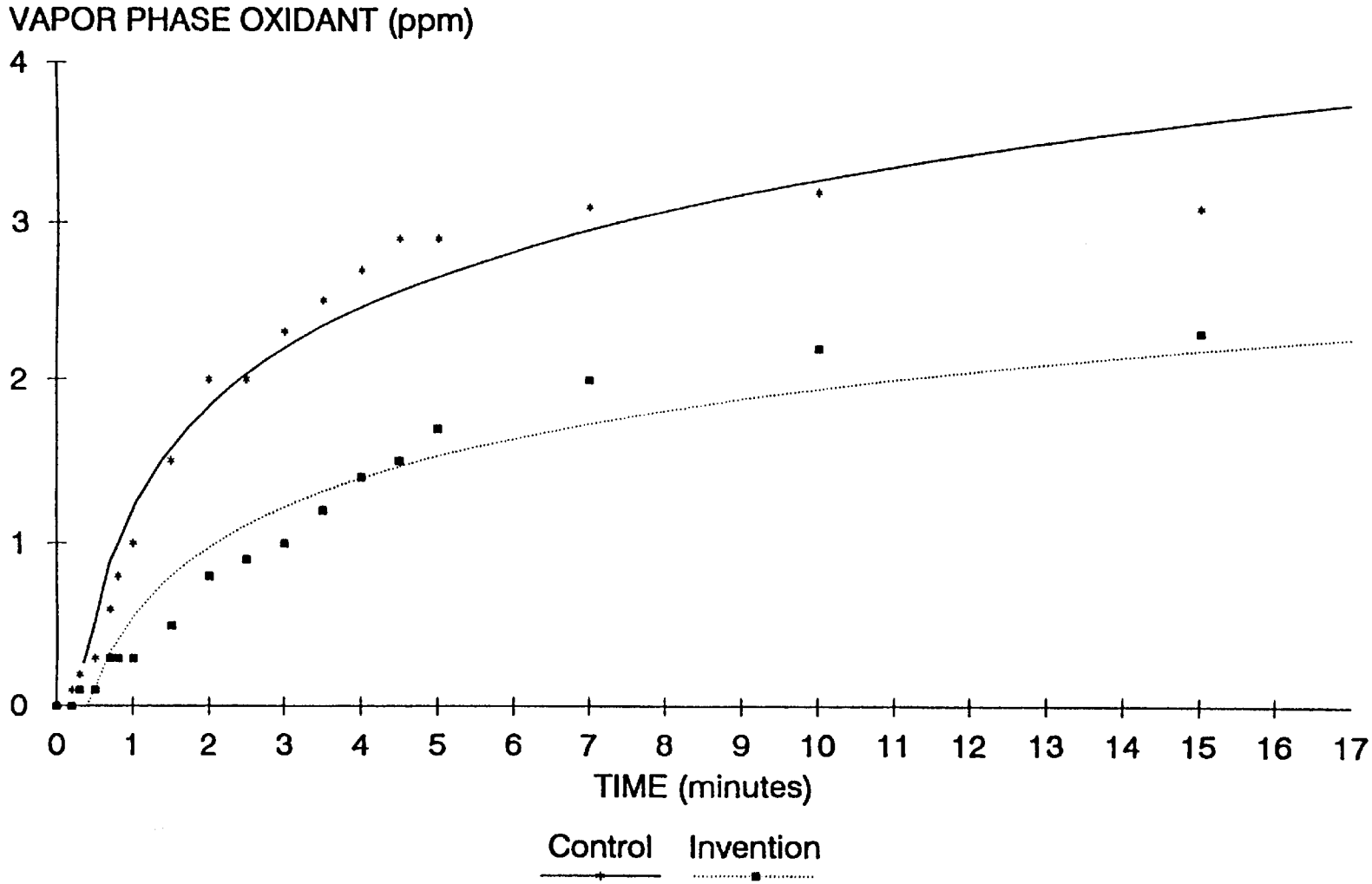
FIG. 3 is a graph showing vapor phase oxidant levels (in ppm) comparing a formulation of the present invention with a non-viscoelastic control.

FIG. 3 is a graphical comparison of vapor-phase oxidant levels for a formulation of the present invention and a leading commercially-available hypochlorite cleaner, both dispensed through a trigger sprayer. Each composition was sprayed once from a distance of 18 inches into a partially enclosed box (having side, bottom and top panels). A Gastech Model 4700 gas detector was employed to detect hypochlorite levels within the box. Results are reported as parts per million over time.

As can be seen from FIG. 3, the present invention resulted in substantially lower levels of hypochlorite compared with the control.

TABLE II

| | Amine Oxide | Percent | Initial Results | | 6 Mo. Results | |
|---|---|---|---|---|---|---|
| Formula | R-length | Counterion | 5 rpm | 100 rpm | 5 rpm | 100 rpm |
| 1 | 14 | .18% | 0 | 18 | 0 | 20 |
| 2 | 14 | .38% | 0 | 16 | 0 | 16 |
| 3 | 15 | .18% | 20 | 40 | 0 | 43 |
| 4 | 15 | .38% | 40 | 24 | 0 | 25 |
| 5 | 16 | 0 | 500 | 141 | 90 | 38 |
| 6 | 16 | .18% | 900 | 190 | 1060 | 285 |
| 7 | 16 | .38% | 760 | 190 | 890 | 212 |
| 8 | 16 | .75% | 60 | 53 | 60 | 57 |
| 9 | 18 | .18% | N/A | N/A | 0 | 17 |
| 10 | 18 | .38% | N/A | N/A | 0 | 11 |

Base formulation included: 5.2–5.8% NaOCl, 1.6–1.8% NaOH, 0.11% sodium silicate, 0.5% amine oxide. Viscosity was measured at 21° C. with a Brookfield RVT viscometer, and number 3 spindle. The counterion was sodium xylene sulfonate. Six-month results followed storage at 21° C.

Table II above demonstrates the effect of alkyl group chain length on viscosity development and stability. As shown in the table, only the $C_{16}$ amine oxide develops any appreciable viscosity. While sample number 5, containing no counterion, developed viscosity initially, the viscosity was not stable and degenerated rapidly as shown by the six-month result. This sample did not result in a clear, phase stable initial formulation, owing to the absence of counterion. In comparison, the viscosity developed by samples 6, 7 and 8 of the present invention was stable over time. These samples were clear and phase stable initially, and after the six-month storage period. The shear thinning behavior of these formulations is also demonstrated. Also shown in Table II, for a formulation including sodium silicate as an electrolyte, the optimum weight ratio of amine oxide to counterion viscosity is about 2.7:1. It should be noted that the viscosity measurements shown in Tables II and III are shear, not extensional viscosities. The weight ratios of amine oxide to counterion are illustrative of the properties of the present invention, but do not correspond exactly to the ratios designed to optimize extensional viscosity as taught herein.

TABLE III

| Formula | Amine Oxide | Counter-ion | Initial Results 5 rpm | Initial Results 100 rpm | Six Month Results 5 rpm | Six Month Results 100 rpm |
|---|---|---|---|---|---|---|
| 11 | 0.11 | 0.1 | 20 | 200 | 0 | 15 |
| 12 | 0.23 | 0.18 | 240 | 81 | 220 | 140 |
| 13 | 0.5 | 0.35 | 780 | 177 | 830 | 231 |
| 14 | 1.0 | 0.7 | 2340 | 258 | 2640 | 335 |
| 15 | 0.11 | 0.1 | 20 | 22 | 0 | 0 |
| 16 | 0.25 | 0.18 | 100 | 40 | 90 | 50 |
| 17 | 0.5 | 0.35 | 640 | 100 | 600 | 133 |
| 18 | 1.0 | 0.7 | 1940 | 216 | 1500 | 202 |

Formulas 11–14 included 5.2–5.8% NaOCl, 1.6–1.8% NaOH, 0.11% sodium silicate.
Formulas 15–18 included 5.0–5.2% NaOCl, 0.5% NaOH.
All measurements taken at 21° C. using a Brookfield RVT viscometer and number 3 spindle.
The amine oxide was hexadecyl dimethyl, and counterion was sodium xylene sulfonate.

Table III above demonstrates viscosity and phase stability for eight formulations of the present invention. Formulations 11–14 include a slightly higher hypochlorite level, a higher pH and added electrolyte, compared to formulations 15–18. The formulas in Table III all contain amine oxide to counterion a ratio of approximately 2:1.4. It can be seen that, while a higher total surfactant concentration tends to result in higher viscosity, optimal from a viscosity stability standpoint appears to be a surfactant concentration somewhat under about 1%. All of the foregoing formulations were phase stable, even after six months' storage.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

What is claimed is:

1. A stable thickened viscoelastic cleaning composition, comprising, in aqueous solution:

(a) about 0.1 to 15 weight percent of a cleaning active; and (b) about 0.2 to 7.5 weight percent of a viscoelastic thickening system consisting essentially of:

(i) about 0.1 to 5.0 weight percent of a hexadecyl di ($C_{1-2}$ alkyl) amine oxide component having an alkyl chain length distribution of at least 80% C16; and (ii) about 0.1 to 2.5 weight percent of an organic anionic counterion selected from the group consisting of aryl or $C_{2-6}$ alkyl sulfonates, aryl or C2–6 alkyl carboxylates, sulfated $C_{2-6}$ alkyl or aryl alcohols and mixtures thereof, said aryl groups being derived from benzene or naphthalene and being unsubstituted or substituted with $C_{1-4}$ alkyl groups, $C_{1-4}$ alkoxy groups, halogens, nitro groups or mixtures thereof;

wherein the ratio of amine oxide component to counterion is between 4:1 and 1:2, the thickening system possesses a Trouton ratio of greater than about 50 at a shear rate of between 500–10,000 $sec^{-1}$, an initial viscosity measured at 21° C. and 5 rpm is at least about 20 cP; the composition pH is above about 10.5: and the cleaning active is other than a hexadecyl di ($C_{1-2}$ alkyl) amine oxide.

2. The thickening system of claim 1 wherein the cleaning active is a hypochlorite-releasing compound.

3. The thickening system of claim 1 wherein the amine oxide has a chain length distribution of at least 95% $C_{16}$.

4. The thickening system of claim 1 wherein the Trouton ratio is at least 70.

5. The thickening system of claim 1 wherein the cleaning active is selected from acids, bases, oxidants, reductants, solvents, enzymes, thioorganic compounds, surfactants, and mixtures thereof, except that the surfactant is other than a hexadecyl di ($C_{1-2}$ alkyl) amine oxide.

6. In an aqueous solution of a stable thickened viscoelastic cleaning composition comprising about 0.1 to 15 weight percent of a cleaning active other than a hexadecyl di ($C_{1-2}$ alkyl) amine oxide and a viscoelastic thickening system, an improved viscoelastic thickening system consisting essentially of:

(a) about 0.1 to 5.0 weight percent of a hexadecyl di($C_{1-2}$ alkyl) amine oxide component having an alkyl chain length distribution of at least 80% $C_{16}$; and (b) about 0.1 to 2.5 weight percent of an organic anion counterion selected from the group consisting of aryl or $C_{2-6}$ alkyl sulfonates, aryl or $C_{2-6}$ alkyl carboxylates, sulfated $C_{2-6}$ alkyl or aryl alcohols and mixtures thereof, said aryl groups being derived from benzene or napthalene and being unsubstituted or substituted with $C_{1-4}$ alkyl groups, $C_{1-4}$ alkoxy groups, halogens, nitro groups or mixtures thereof;

wherein the ratio of amine oxide component to counterion is between 4:1 and 1:2, the thickening system possesses a Trouton ratio of greater than about 50 at a shear rate of between 500–10,000 $sec^{-1}$, the composition pH is above about 10.5, and an initial viscosity measured at 21° C. and 5 rpm is at least about 20 cP.

* * * * *